US006250946B1

(12) United States Patent
Tardy

(10) Patent No.: US 6,250,946 B1
(45) Date of Patent: Jun. 26, 2001

(54) EXTENSION CORD PLUG COVER

(76) Inventor: Don E. Tardy, 608 Fairlawn Dr., Terrytown, LA (US) 70056

( * ) Notice: Subject to any disclaimer, the term of this patent is extended or adjusted under 35 U.S.C. 154(b) by 0 days.

(21) Appl. No.: 09/577,204

(22) Filed: May 23, 2000

(51) Int. Cl.[7] ..... H01R 13/62
(52) U.S. Cl. ..... 439/367; 439/369
(58) Field of Search ..... 439/367, 369

(56) References Cited

U.S. PATENT DOCUMENTS

| | | | | |
|---|---|---|---|---|
| 5,299,951 | | 4/1994 | Blaetz | 439/367 |
| 5,306,176 | | 4/1994 | Coffey | 439/367 |
| 5,368,500 | * | 11/1994 | Dedering | 439/367 |
| 5,505,634 | | 4/1996 | Osten | 439/369 |
| 5,772,462 | | 6/1998 | Osten | 439/367 |
| 5,782,649 | | 7/1998 | Aiken | 439/369 |
| 5,813,879 | | 9/1998 | Russo | 439/367 |

* cited by examiner

*Primary Examiner*—Brian Sircus
(74) *Attorney, Agent, or Firm*—Joseph N. Breaux

(57) ABSTRACT

An extension cord plug cover that is sealable over a connected extension cord plug and socket to provide a watertight seal therearound. The plug cover includes a hard plastic clamshell cover filled with a resilient closed cell foam material having contoured plug/socket cavities which is compressed around the extension cord plug and socket to form a watertight seal when the two clamshell halves are forced together when the clamshell cover is in the closed position.

1 Claim, 5 Drawing Sheets

EXTENSION CORD PLUG COVER

TECHNICAL FIELD

The present invention relates to electrical safety devices and more particularly to an extension cord plug cover for sealing the connected plug and socket ends of two extension cord in a watertight manner; the extension cord plug cover including a two-piece, hard plastic, closeably securable, clamshell housing including two hollow half clamshell members hingedly connected and each provided with two cord passage openings positioned such that each cord passage opening of one of the two hollow half clamshell members are in alignment with one of the two cord passage openings of the other of the two hollow half clamshell members when the two hollow half clamshell members are pivoted and closeably secured into a closed configuration, each of the two hollow half clamshell members being filled with a resiliently, shape conformable closed cell foam having contoured plug/socket receiving cavities formed therein, the closed cell foam being sufficiently deformable to form a watertight seal around a plug end of one extension cord and a socket end of another extension cord to be positioned within the extension cord plug cover when the two hollow half clamshell members are pivoted and snap closed into the closed configuration.

BACKGROUND ART

It is often necessary to supply power in an out of the way location to hook multiple extension cords in series by connecting the plug end of one extension cord into the socket end of another extension cord. Although this provides an adequate electrical connection, it is often dangerous to have an unsealed electrical connection when rain or snow are present on the ground. It would be desirable, therefore, to have an extension cord plug cover that was sealable over a connected extension cord plug and socket to provide a watertight seal therearound.

GENERAL SUMMARY DISCUSSION OF INVENTION

It is thus an object of the invention to provide an extension cord plug cover that includes a two-piece, hard plastic, closeably securable, clamshell housing including a two-piece, hard plastic, closeably securable, clamshell housing including two hollow half clamshell members hingedly connected and each provided with two cord passage openings positioned such that each cord passage opening of one of the two hollow half clamshell members are in alignment with one of the two cord passage openings of the other of the two hollow half clamshell members when the two hollow half clamshell members are pivoted and closeably secured into a closed configuration, each of the two hollow half clamshell members being filled with a resiliently, shape conformable closed cell foam having contoured plug/socket receiving cavities formed therein, the closed cell foam being sufficiently deformable to form a watertight seal around a plug end of one extension cord and a socket end of another extension cord to be positioned within the extension cord plug cover when the two hollow half clamshell members are pivoted and snap closed into the closed configuration.

Accordingly, an extension cord plug cover is provided. The extension cord plug cover includes a two-piece, hard plastic, closeably securable, clamshell housing including two hollow half clamshell members hingedly connected and each provided with two cord passage openings positioned such that each cord passage opening of one of the two hollow half clamshell members are in alignment with one of the two cord passage openings of the other of the two hollow half clamshell members when the two hollow half clamshell members are pivoted and closeably secured into a closed configuration, each of the two hollow half clamshell members being filled with a resiliently, shape conformable closed cell foam having contoured plug/socket receiving cavities formed therein, the closed cell foam being sufficiently deformable to form a watertight seal around a plug end of one extension cord and a socket end of another extension cord to be positioned within the extension cord plug cover when the two hollow half clamshell members are pivoted and snap closed into the closed configuration.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
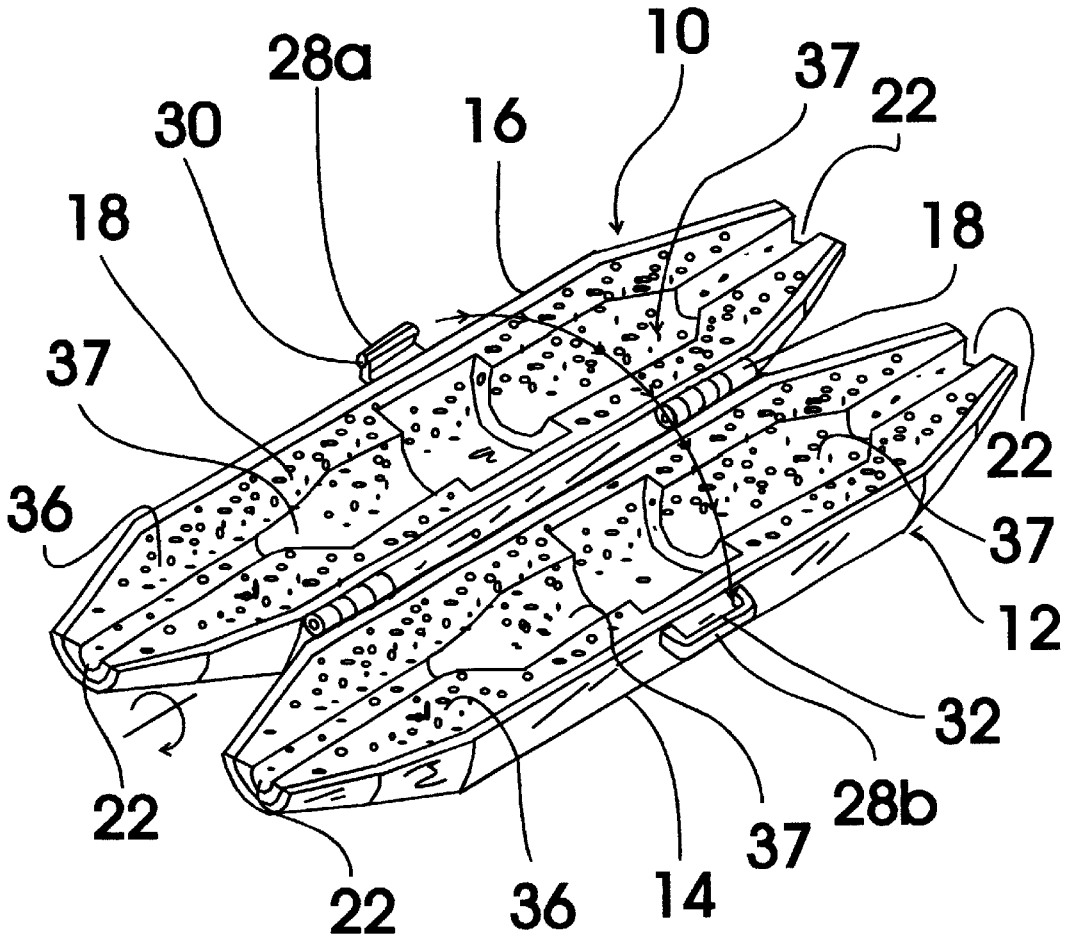
FIG. 1 is a perspective view of an exemplary embodiment of the extension cord plug cover of the present invention showing the two-piece, hard plastic, snap closable, clamshell housing including two hollow half clamshell members hingedly connected and each provided with two cord passage openings positioned such that each cord passage opening of one of the two hollow half clamshell members are in alignment with one of the two cord passage openings of the other of the two hollow half clamshell members when the two hollow half clamshell members are pivoted and snap closed into a closed configuration, each of the two hollow half clamshell members being filled with a resiliently, shape conformable closed cell foam.
Figure 2:
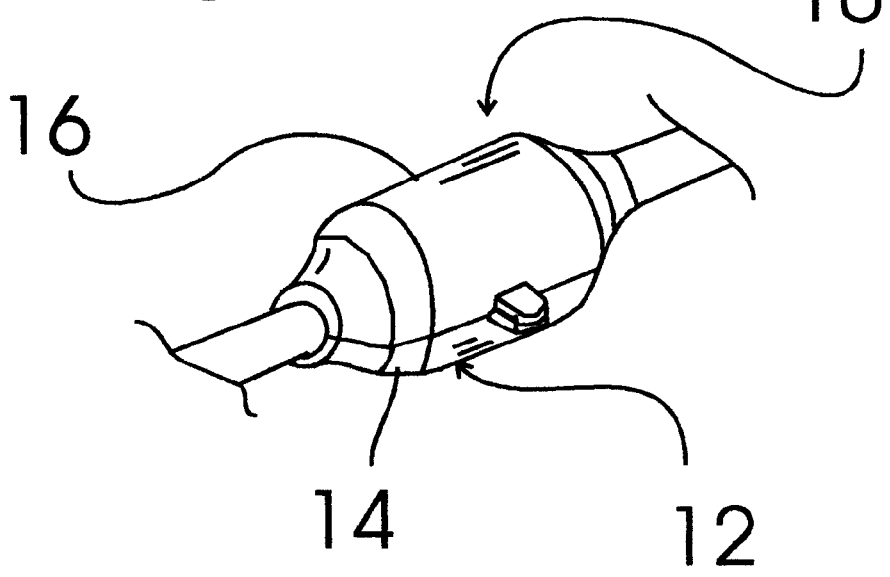
FIG. 2 is a perspective view showing the extension cord plug cover of FIG. 1 in the closed configuration with sections of different extension cords extending out through the cord passage openings.
Figure 3:
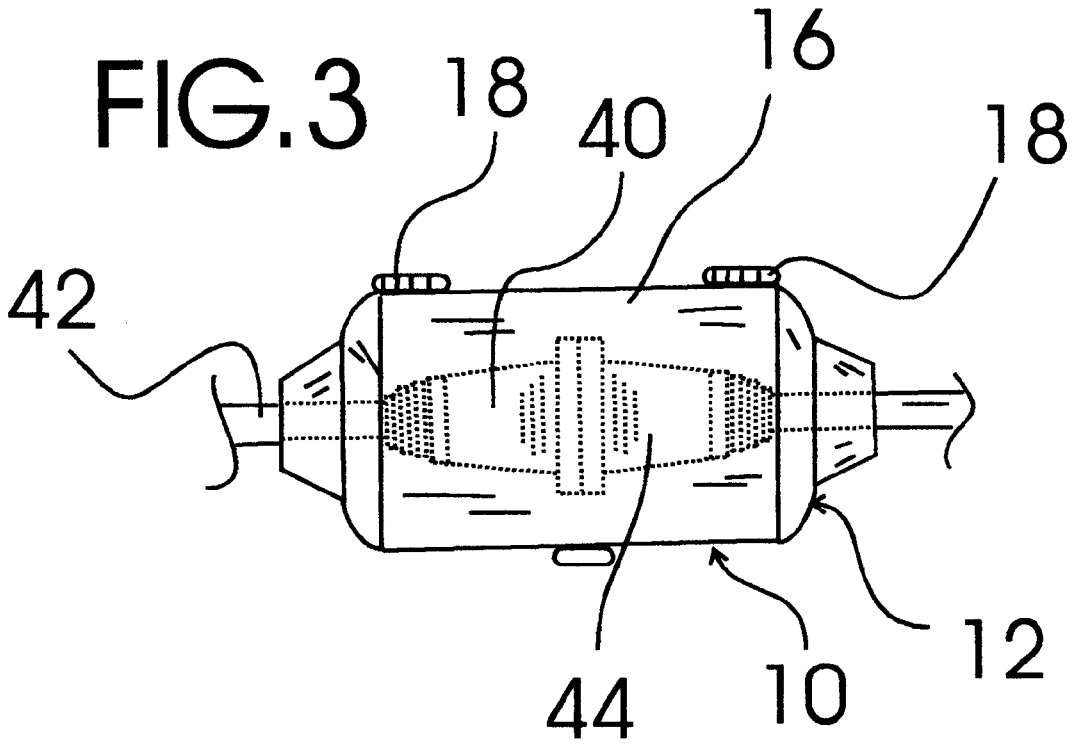
FIG. 3 is a top plan view showing a plug end of one extension cord connected to a socket end of another extension cord and positioned within the exemplary extension cord plug cover of FIG. 1.

FIGS. 1–3 show various aspects of an exemplary embodiment of the extension cord plug cover of the present invention generally designated 10. Extension cord plug cover 10 includes a two-piece, hard plastic, closeably securable, clamshell housing, generally designated 12 including two hollow half clamshell members 14,16 hingedly connected with two hinges 18. Each of the hollow half clamshell members 14,16 includes two half-circular cord passage openings 22 that are coaxially aligned with the other cord passage opening 22 on the same clamshell member 14,16 and positioned such that each cord passage opening 22 of each of the two hollow half clamshell members 14,16 is in alignment with one of the two cord passage openings 22 of the other of the two hollow half clamshell members 14,16 when the two hollow half clamshell members 14,16 are pivoted and closeably secured into a closed configuration with snap fastener halves 28*a,*28*b*. Snap fastener half 28*a* includes an enlarged portion 30 that snaps fits through the opening 32 of snap fastener half 28*b*. Each of the two hollow half clamshell members 14,16 is filled with a resilient, shape conformable, closed cell foam 36 that has two contoured plug/socket cavities 37 formed therein. Resilient, shape conformable, closed cell foam 36 is sufficiently deformable to form a watertight seal around a plug end 40 of one extension cord 42 and a socket end 44 of another extension cord 46 that is positioned within extension cord plug cover 10 when the two hollow half clamshell members 14,16 are pivoted and snap closed into the closed configuration.

Figure 4:
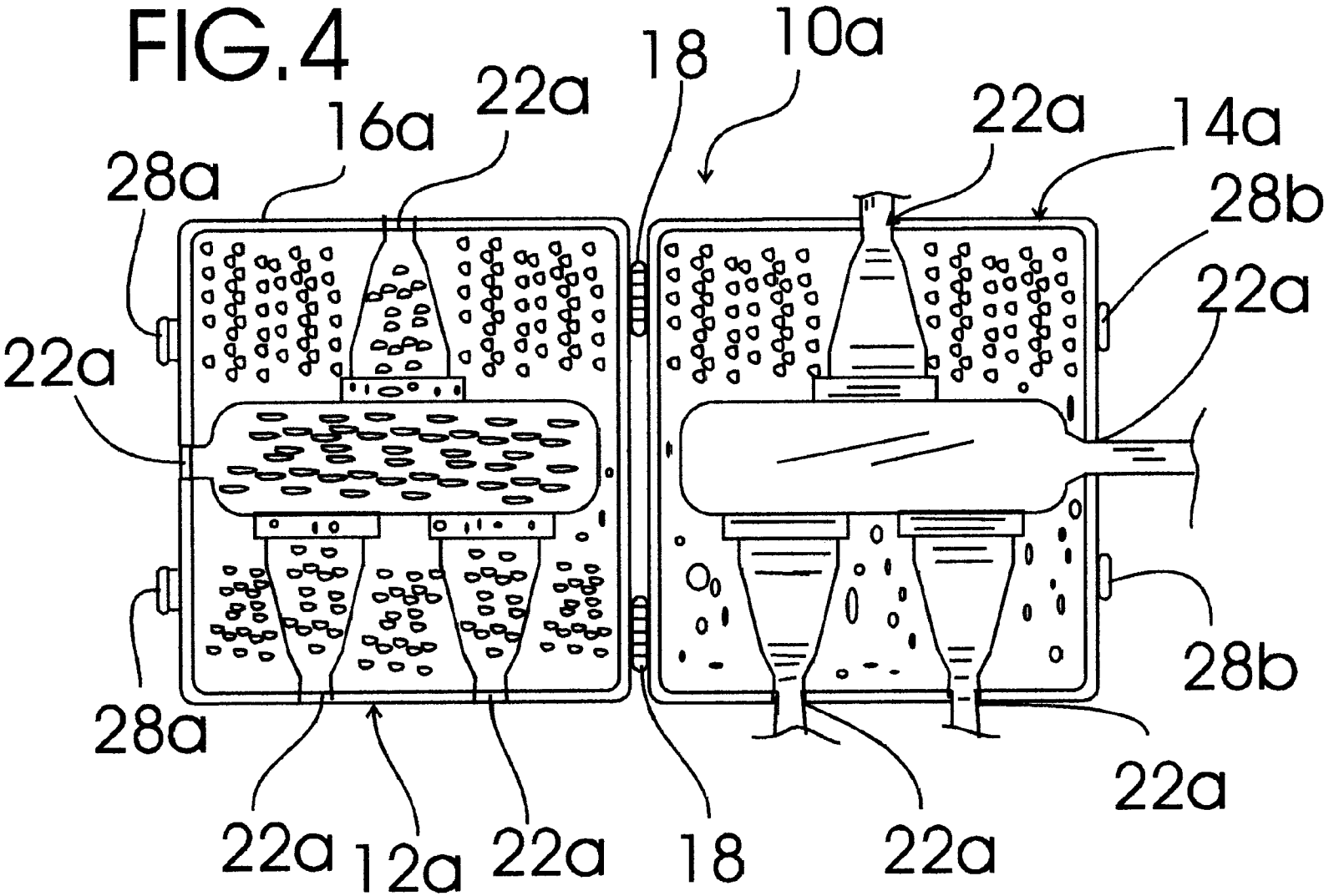
FIG. 4 is a top plan view of a second exemplary embodiment of the extension cord plug cover of the present invention that included four cord passage openings in each of the two hollow half clamshell members of the two-piece, hard plastic, snap closable, clamshell housing.
Figure 4A:
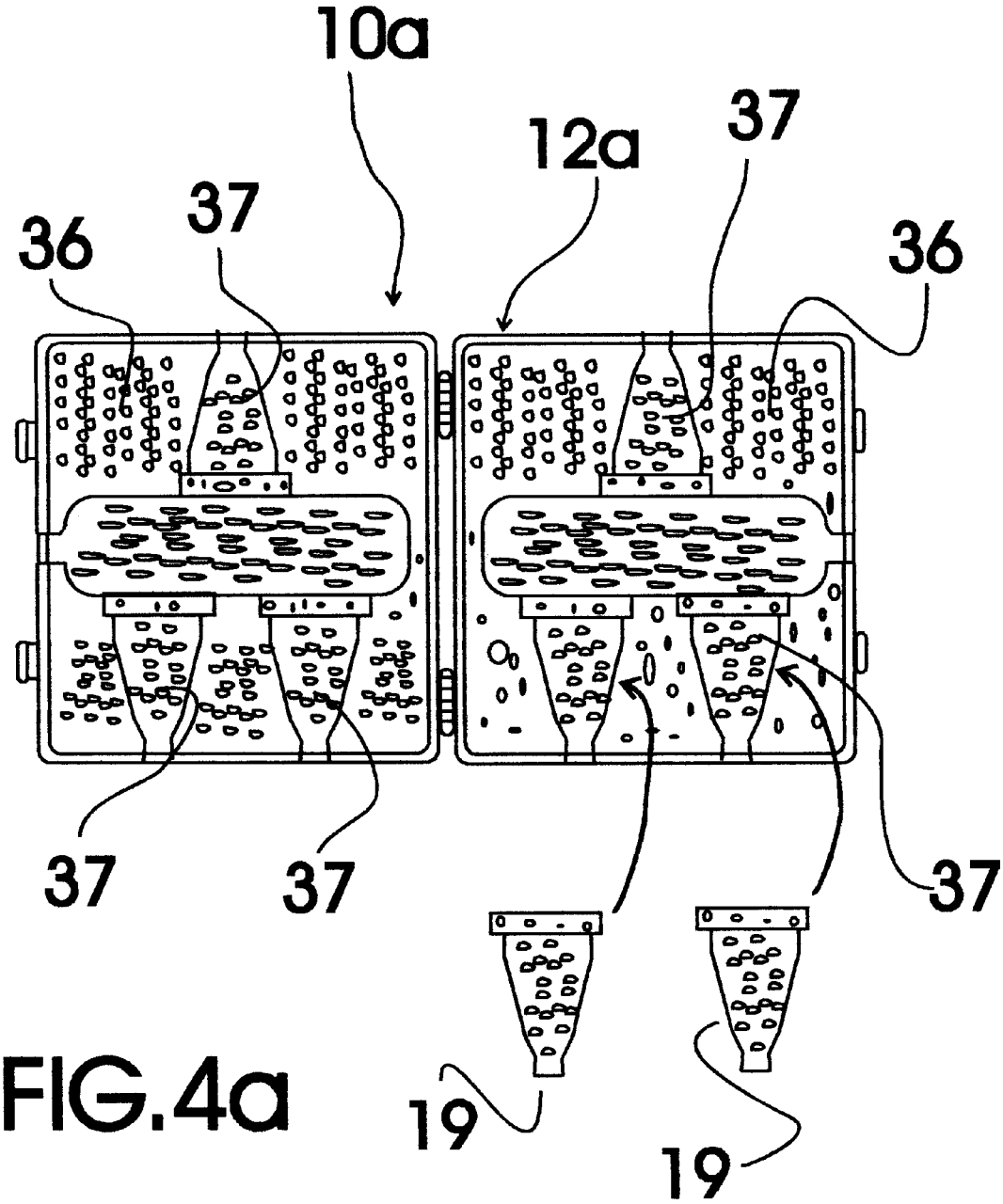
FIG. 4*a* is a second top plan view of the second exemplary embodiment of FIG. 4 showing the resilient foam plug members that are used to seal the contoured plug/socket receiving cavities when only one plug is plugged into a multiple socket extension cord.
Figure 5:
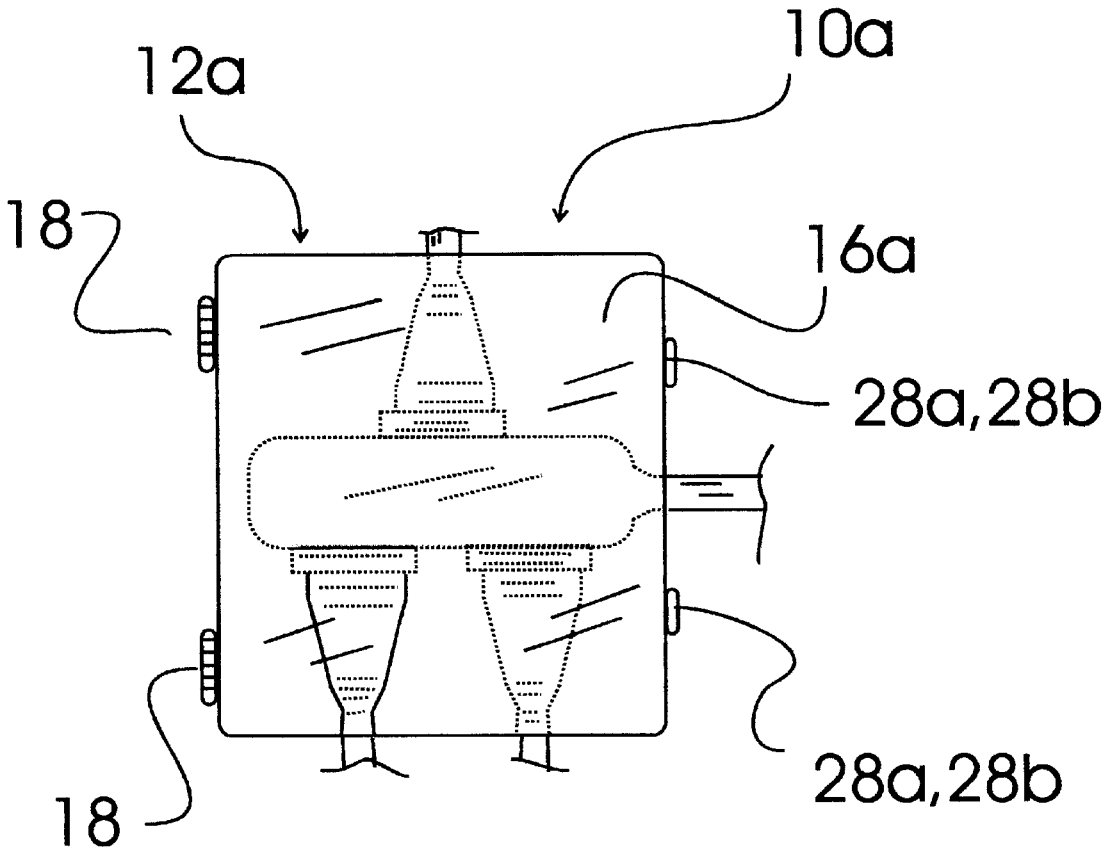
FIG. 5 is a top plan view showing the plug ends of three extension cords connected to a multi-connect socket end of another extension cord and positioned within the exemplary extension cord plug cover of FIG. 4.

FIGS. 4, 4*a,* and 5 show a second exemplary embodiment of the extension cord plug cover of the present invention generally designated 10*a*. Extension cord plug cover 10*a* includes a two-piece, hard plastic, closeably securable, clamshell housing, generally designated 12*a,* that includes two hollow half clamshell members 14*a,*16*a* hingedly connected with two hinges 18; and two resilient foam plug members 19 each shaped to seat into and seal two of the contoured plug/socket cavities 37 formed within the foam members 36 when clamshell members 14*a,*16*a* are in the closed configuration. Each of the hollow half clamshell members 14*a,*16*a* includes four half-circular cord passage openings 22*a* that are positioned such that each cord passage opening 22*a* of each of the two hollow half clamshell members 14*a,*16*a* is in alignment with one of the four cord passage openings 22*a* of the other of the two hollow half clamshell members 14*a,*16*a* when the two hollow half clamshell members 14*a,*16*a* are pivoted and closeably secured into a closed configuration with snap fastener halves 28*a,*28*b*. Extension cord plug cover 10*a* is used in the same manner as extension cord plug cover 10 except that one or more of the two resilient foam plug members 19 into one or more of the contoured plug/socket cavities 37 when less than four extension cords are used with extension cord plug cover 10*a*

It can be seen from the preceding description that an extension cord plug cover has been provided.

It is noted that the embodiment of the extension cord plug cover described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An extension cord plus cover comprising:

a two-piece, hard plastic, closeable securable, clamshell housing including two hollow half clamshell members hingedly connected and each provided with two cord passage openings positioned such that each said passage opening of one of said hollow half clamshell members are in alignment with one of said two cord passage openings of said other of said two hollow half clamshell members when said two hollow half clamshell members are pivoted and closeably secured into a closed configuration, each of said two hollow half clamshell members being filled with a resiliently, shape conformable closed cell foam having contoured plug/socket receiving cavities formed therein, said closed cell foam being sufficiently deformable to form a watertight seal around a plug end of one extension cord and a socket end of another extension cord to be positioned within said extension cord plug cover when said two hollow half clamshell members are pivoted and snap closed into said closed configuration; and a resilient foam plug member shaped to seat into and simultaneously seal two of the contoured plug/socket cavities when said two hollow half clamshell members are in said closed configuration.

* * * * *